US005624366A

United States Patent [19]

Beeri

[11] Patent Number: 5,624,366

[45] Date of Patent: Apr. 29, 1997

[54] LAUNDRY SHEET FOLDING APPARATUS

[76] Inventor: Avri A. Beeri, 3262 Smith Farm Rd., Matthews, N.C. 28105

[21] Appl. No.: 267,486

[22] Filed: Jun. 29, 1994

[51] Int. Cl.[6] ..... B31F 1/00; B31B 1/00

[52] U.S. Cl. ..... 493/23; 493/418; 493/450

[58] Field of Search ..... 270/32, 45, 51; 223/37; 493/418, 450, 458, 416, 422, 423, 436, 441, 23

[56] References Cited

U.S. PATENT DOCUMENTS

| | | | |
|---|---|---|---|
| 3,113,772 | 12/1963 | Malott et al. | 493/14 |
| 3,310,207 | 3/1967 | Gore | 493/458 X |
| 3,339,914 | 9/1967 | Grantham | 493/458 X |
| 3,361,424 | 1/1968 | Kamberg | 493/418 X |
| 3,363,897 | 1/1968 | Northern et al. | 493/23 |
| 3,419,261 | 12/1968 | Sjostrom | 493/418 |
| 3,462,138 | 8/1969 | Grantham | 493/444 X |
| 3,477,708 | 11/1969 | Henry et al. | 493/418 X |
| 3,559,983 | 2/1971 | Sjostrom . | |
| 3,702,696 | 11/1972 | Teed | 493/418 X |
| 3,706,450 | 12/1972 | Gerstenberger et al. | 493/418 X |
| 3,744,785 | 7/1973 | Grantham | 270/45 |
| 3,828,989 | 8/1974 | Heater . | |
| 4,061,326 | 12/1977 | Proudman | 493/418 X |
| 4,479,640 | 10/1984 | Smith | 270/32 |
| 5,079,867 | 1/1992 | Kober et al. | 223/37 X |

FOREIGN PATENT DOCUMENTS

| | | | |
|---|---|---|---|
| 1-310700 | 12/1989 | Japan | 223/37 |

*Primary Examiner*—John E. Ryznic
*Attorney, Agent, or Firm*—Shefte, Pinckney & Sawyer

[57] ABSTRACT

An apparatus for folding and stacking a multiplicity of individual sheets of material, particularly textile material, includes an upstanding frame with the outermost extent thereof defining a frame perimeter, an assembly mounted to the frame for feeding the textile sheet material through the folding apparatus in a predetermined travel direction along a predetermined travel path for sheet material folding. A folding assembly is disposed along the travel path for folding the sheet material with the folding assembly being disposed within the frame perimeter and an assembly for stacking the sheets is provided and is also disposed within the frame perimeter.

15 Claims, 4 Drawing Sheets

LAUNDRY SHEET FOLDING APPARATUS

BACKGROUND OF THE INVENTION

The present invention relates broadly to automated apparatus for folding sheet material, particularly textile sheet material, into substantially equally sized sections and, more particularly, to an apparatus for folding and stacking a multiplicity of individual sheets of material wherein the folding and stacking takes place within the perimeter defined by the frame of the apparatus.

Commercial laundries which service hotels, restaurants, hospitals and other public facilities launder a multitude of textile material sheets, typically in the form of bed sheets, both fitted and non-fitted, blankets, and tablecloths. Further, textile mills produce the aforesaid sheet items, including knitted sheets, both fitted and non-fitted, which also must be folded. Since these items are typically too large to handle unfolded, the sheets are folded into predetermined, equally sized sections for transportation and storage prior to continued use. Folding such sheets by hand would be unnecessarily labor intensive and time consuming. Accordingly, automatic devices have been developed for folding flat textile sheet material into predetermined, equally sized sections. These machines are typically large, floor standing framed devices which include a plurality of feeder elements for feeding the textile material through the machine in a predetermined path. Along the path, the sheets are manipulated in a manner so as to fold them into the aforesaid predetermined sections. Folding is typically accomplished by air blasts directing a midpoint of the sheet into a nip or by selectively movable mechanical projections which manipulate the sheets into a folded condition.

Two separate problems typically exist with current sheet folding machines. First, once each sheet is folded it must be removed from the machine by hand and stacked along with other folded sheets. This operation can be both labor intensive and time consuming. Further, it requires an alert, attentive operator to remove sheets as they are folded. As a solution, sheet stackers have come into use which are attachments to current folding machines.

The solution to the first problem gives rise to the second problem. The stackers used to receive and stack the material sheets are fitted as an addition to the folding machine somewhere along the outside of the frame which adds to the bulk of the folding machine. Heretofore, stackers could not be fitted within the frame of the machine due to the requirements imposed by the arrangement of the sheet folding elements within the folding machine itself.

SUMMARY OF THE INVENTION

It is accordingly an object of the present invention to provide a sheet folding and stacking apparatus which folds and stacks a multiplicity of individual sheets of material within a frame structure that is typically no larger than current sheet folding apparatus.

To that end, an apparatus for folding and stacking a multiplicity of individual sheets of material includes an upstanding frame with the outermost extent thereof defining a frame perimeter, an arrangement mounted to the frame for feeding sheet material through the apparatus in a predetermined travel direction along a predetermined travel path for folding thereof, an assembly for folding the sheet material disposed along the travel path, and an arrangement for stacking the sheets. Both the folding assembly and the stacking arrangement are disposed within the frame perimeter. Preferably, the apparatus of the present invention includes an arrangement for removing the stacked sheet material from within the frame perimeter. It is preferred that the removing arrangement include a conveyor for moving the sheet material from within the frame perimeter.

The present invention preferably includes a sensing arrangement for sensing the position of the sheet material and the folding assembly includes an assembly for folding the sheet material into predetermined sections responsive to an input from the sensing arrangement. Preferably, a microprocessor arrangement is provided for controlling and coordinating the operation of the feeding arrangement, the folding assembly and the stacking arrangement.

It is preferred that the frame include a primary frame defining the frame perimeter and a secondary frame mounted to the primary frame within the frame perimeter. The folding assembly then preferably includes an assembly for performing at least one fold mounted to the primary frame and an assembly for performing at least one fold mounted to the secondary frame. The stacking arrangement is mounted to the secondary frame.

It is preferred that the feeding arrangement include a plurality of conveyors including a plurality of endless belts trained around rollers at least one of which is driven.

It is further preferred that the stacking arrangement include at least one trap door in communication with the feeding arrangement. Preferably, the trap door is positioned above the sheet removing arrangement for dropping folded sheet material thereon.

DETAILED DESCRIPTION OF THE PREFERRED EMBODIMENT

Figure 1:
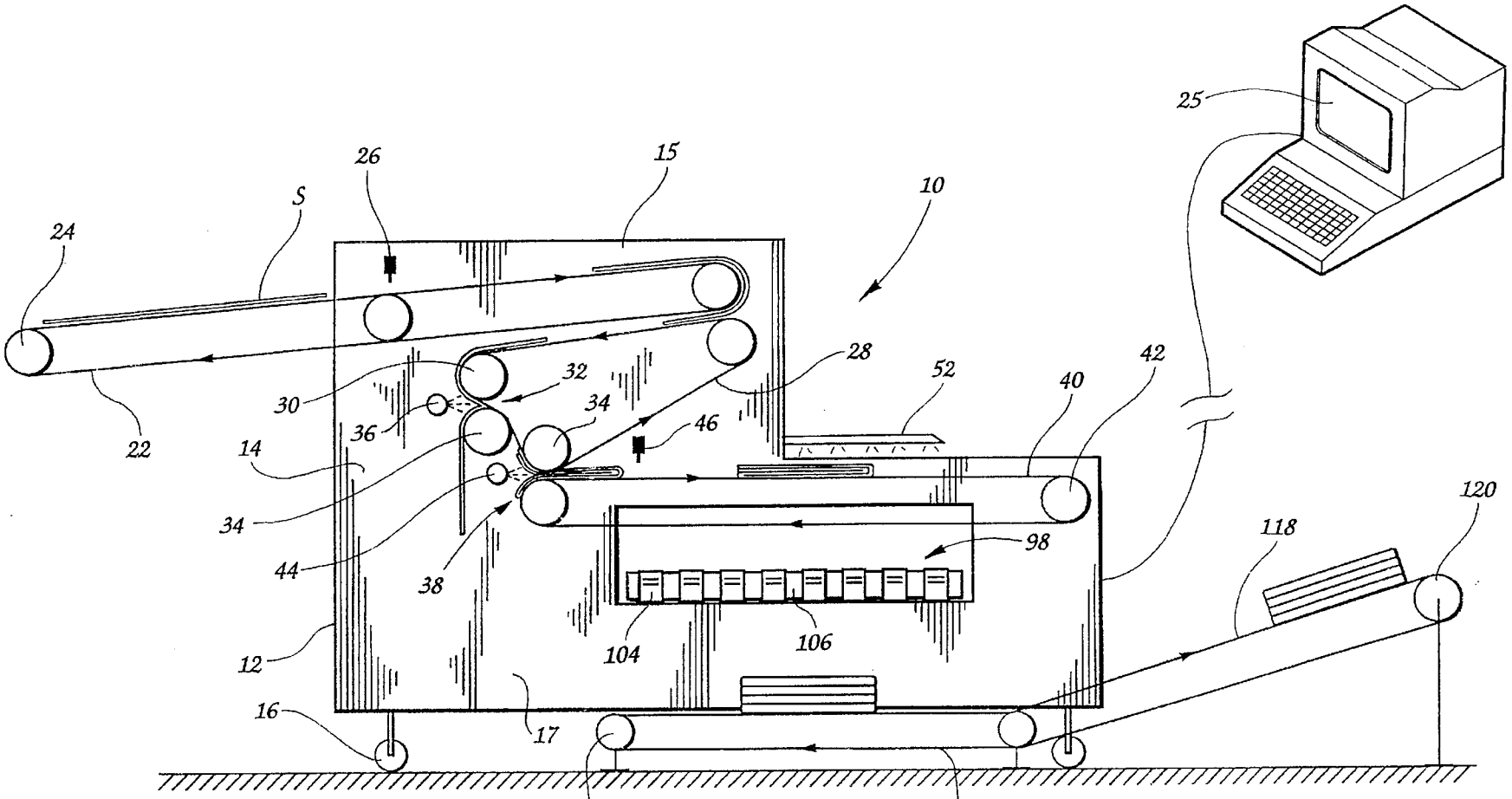
FIG. 1 is a diagrammatic side elevational view of an apparatus for folding and stacking a multiplicity of individual sheets of material according to the preferred embodiment of the present invention.

Turning now to the drawings and particularly to FIG. 1, an apparatus for folding and stacking a multiplicity of individual sheets of material, particularly textile material, is illustrated generally at 10. The apparatus 10 includes a primary frame 12 covered with an outer skin 14 preferably formed of sheet metal. The primary frame 12 is a generally rectangular, upstanding frame formed of vertical and horizontal cross members and includes a superstructure 15 extending upwardly from one side thereof, as seen in FIG. 1, to define a lower, or secondary frame structure 17. The entire frame 12 is a floor standing unit resting on feet 16. The frame 12 defines a frame perimeter bounded by the four corners of the primary frame 12. As will be seen, and as is a feature of the present invention, all folds and the stacking operation take place within the frame perimeter.

A series of conveyors acts as a feeding arrangement for feeding the sheet material through the apparatus 10 for folding. The conveyors define a travel direction along a travel path along which the sheet material is fed through the machine. Folds can either be lateral folds produced by folding the sheet from back to front or front to back along the direction of travel, or cross folds produced by moving the sheet from side to side across the initial direction of travel. As will be seen, after all lateral folds are complete the sheet is reoriented 90° with respect to the travel direction. Accordingly, for clarity, the crossfolds are described with respect to the initial travel direction.

All conveyors of the present apparatus 10 are of the general type having a plurality of spaced, parallelly oriented belts extending around two or more rolls, one of which is typically driven. Also common to various locations in the machine are sensors which may be optical sensors, such as photocells, which determine the presence or absence of sheet material at a predetermined location, as well as the accuracy of the fold. While the sensors are illustrated in a diagrammatic manner, it should be understood that the following references to "sensor groups" are intended to indicate multiple sensors arranged to perform detection at a single position relative to the folding operation. A plurality of air jets are disposed at strategic locations throughout the apparatus 10 to induce folding by directing the sheet material into a nip. The conveyors, sensor groups, and air jets all cooperate to induce and conduct folding of sheet material throughout the apparatus 10. Coordination and control of these elements is provided by a preprogrammed microprocessor 25 which automatically controls folding operations responsive to input from the sensors and other stimulus. Each element will be explained in greater detail presently.

An input conveyor 22 is trained around three input conveyor rolls 24 and is disposed in the upper reaches of the superstructure 15 and projects outwardly from one side thereof. The input conveyor 22 is angled upwardly slightly and is configured for receiving sheet material from a commercial ironer or other commercial laundry equipment, or from textile manufacturing machines, or other devices for producing or treating unfolded flexible sheet material. Midway along the input conveyor 22, and adjacent the entrance to the apparatus within the superstructure 15, a first sensor group 26 detects when a sheet of material S has entered the apparatus 10.

A second conveyor 28 is disposed beneath the input conveyor 22 and extends parallelly therewith a partial extent. The second conveyor 28 extends from the side of the superstructure 15 opposite the input and is trained around three rolls 30 defining a somewhat triangular path beneath the input conveyor 22. The second conveyor 28 is driven in a direction oppositely to that of the input conveyor 22 so that the return path of the input conveyor travels in the same direction as the conveying path of the second conveyor 28. The second conveyor 28 is routed downwardly approximately midway between the ends of the superstructure 15. As will be explained in greater detail hereinafter, the configuration of the input conveyor 22 and the second conveyor 28 directs the sheet material S into the apparatus and toward the first fold nip 32.

Approximately midway between the ends of the superstructure 15 where the second conveyor 28 turns downwardly, a nip 32 is formed by one of the second conveyor rolls 30 and a first nip roll 34. A first air jet 36 is positioned to direct an air blast inwardly toward the first nip 32. A second nip 38 is similarly formed at the lowermost portion of the second conveyor 28. A third conveyor 40 extends from the second nip 38 along the lower frame structure 17 in a region below the superstructure 15 to the farthest extent of the lower frame structure 17 away from the superstructure 15. The third conveyor 40 is trained around third conveyor rolls 42. The third conveyor roll 42 adjacent the second conveyor 28 acts in tandem with the lowermost second conveyor roll 31 to form the second nip 38. A second air jet 44 is provided to direct an air blast inwardly into the second nip 38 as will be explained in greater detail presently. A second sensor group 46 is disposed along the third conveyor 40 to indicate when the sheet material has emerged from the second nip 38 in a folded state. Noting that the second sensor group 46 represents three photocells aligned across the travel direction, the second sensor group 46 measures the length of the sheet along the travel direction and communicates this information to the controlling microprocessor 25. The microprocessor 25 then determines, according to a predetermined folding program, where to stop the sheet for crossfolding or, if the sheet is improperly laterally folded, to terminate folding for the improperly folded sheet. Further, the information can be stored for subsequently choosing a stacker according to width. The third conveyor 40 is positioned to move the folded sheet material into a position for further folding by the further folding apparatus disposed on a subframe 20 as will be discussed in greater detail hereinafter. The above-described assembly is configured to perform the first two lateral folds while the cross folding apparatus will next be addressed.

Figure 2:
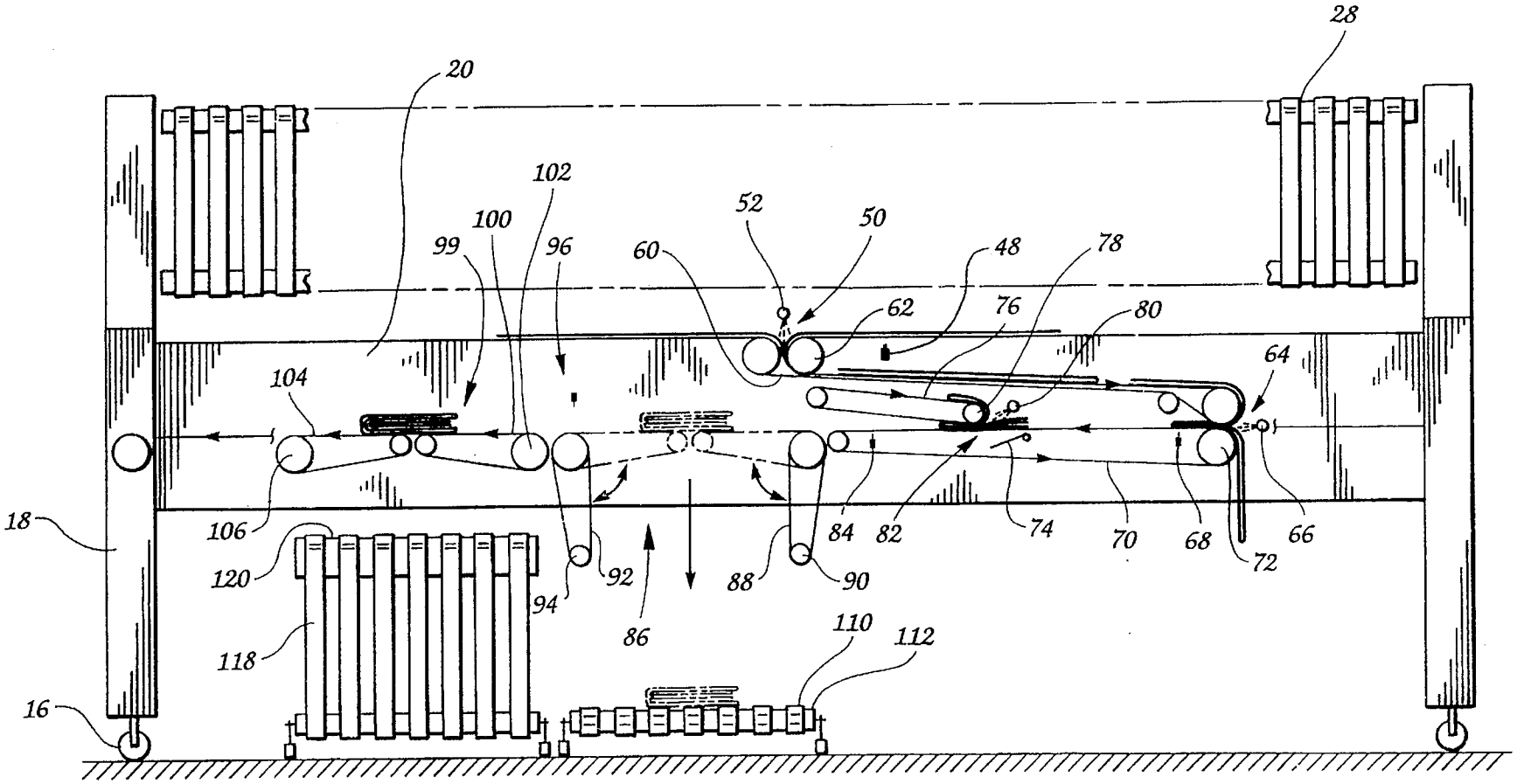
FIG. 2 is a diagrammatic side view of the subframe assembly, including the folding and stacking arrangements, of the folding and stacking apparatus illustrated in FIG. 1.

Turning now to FIG. 2, the lateral folding apparatus is disclosed. FIG. 2 also illustrates the inclined nature of the second conveyor 28. As seen in FIG. 2, a second folding subsystem is disposed on a horizontally extending secondary or subframe 20 mounted to the primary frame 12 to extend between opposite vertical support members 18. In order to conserve space within the apparatus, the previously described folding apparatus illustrated diagrammatically in FIG. 1 drives the sheet material through the apparatus in a first travel direction while the second folding apparatus illustrated in FIG. 2 drives the sheet material through the apparatus in a second travel direction which is generally perpendicular to the first travel direction. Therefore, while FIGS. 1 and 2 illustrate two portions of the same apparatus, the orientations of the apparatus are 90° apart. A slot (not shown) is formed underneath the third conveyor 40 and extends generally parallel with the belts of the third conveyor 40. The sheet can be drawn through the slot for crossfolding, which will be explained in greater detail presently.

With continued reference to FIG. 2, disposed underneath the third conveyor 40 illustrated in FIG. 1, a fourth conveyor 60 is positioned. This conveyor 60 is trained around roller 62 in a manner to form a third nip 50 directly beneath the third conveyor 40. A third sensor group 48 is disposed below the third conveyor 40 adjacent of the third nip 50 to accurately determine the position of the sheet material which would be approaching from above the third sensor 48 on the third conveyor 40. The preferred sensor arrangement includes three photocells mounted in a spaced relationship extending perpendicular to the travel direction. This information can be used to determine whether an optional third crossfold is necessary. For example, a tablecloth greater than 60 inches wide may require three crossfolds, while a tablecloth less than 60 inches wide may require only two crossfolds. The third sensor group 48 is communicated with the microprocessor 25 to control crossfolding. Finally, since the width dimension becomes, effectively, the length when crossfolding begins and the sheet encounters conveyors oriented 90° away from those in the lateral fold area, the information can be used to coordinate the second crossfold, since some crossfolds are not half-folds. For example, a fitted sheet is typically crossfolded in thirds.

A third air jet 52 is mounted above the third nip 50 to direct an air jet thereinto between the two to initiate folding.

Figure 3:
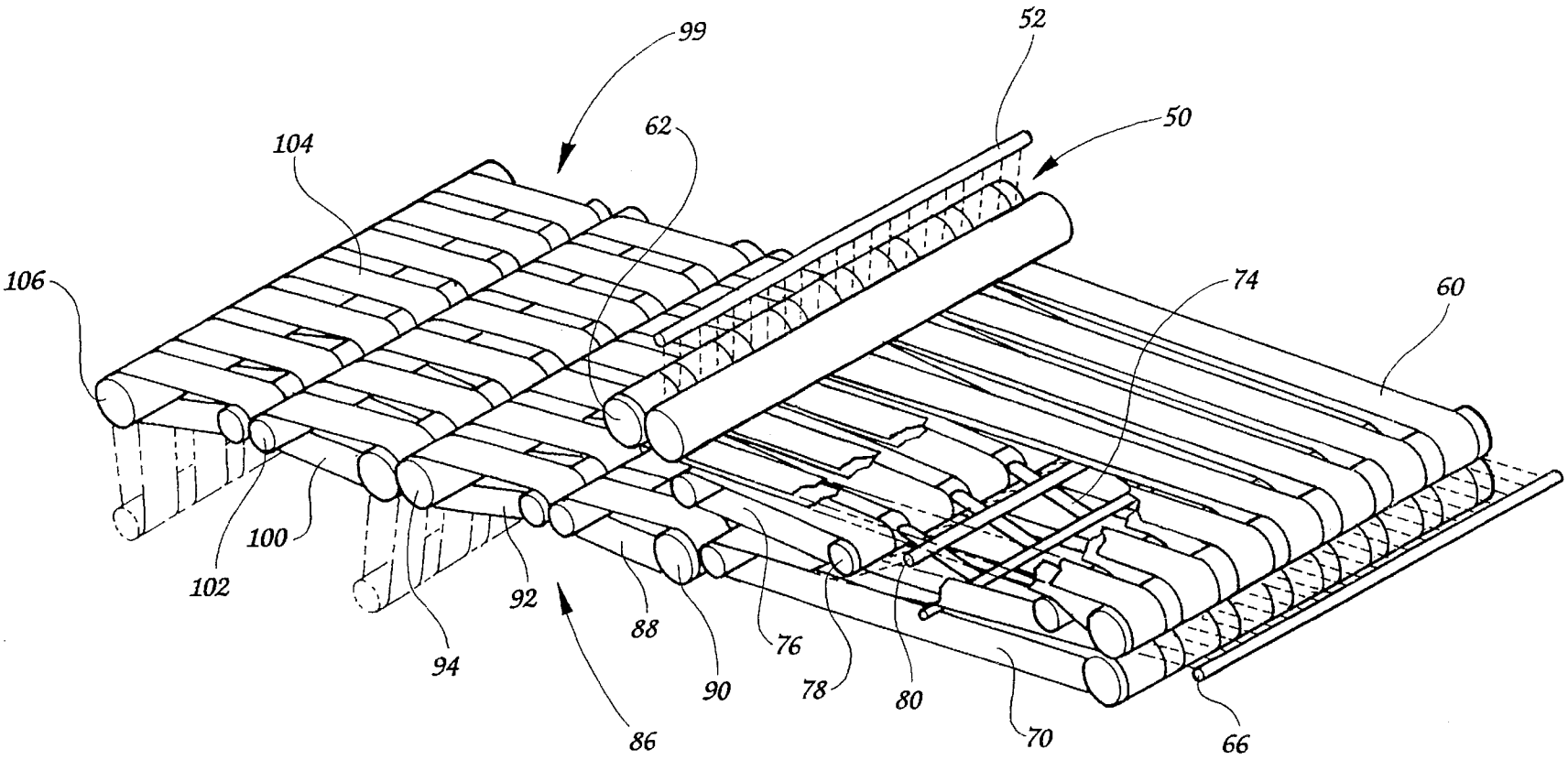
FIG. 3 is a perspective view of the folding and stacking arrangement illustrated in FIG. 2.

The fourth conveyor 60 extends to a position adjacent one end of the subframe 20. Directly below the fourth conveyor, a fifth conveyor 70 is mounted to the subframe 20 and is trained around fifth conveyor roll 72. Adjacent fourth conveyor rolls 62 and fifth conveyor rolls 72 are mounted to form a fourth nip 64 therebetween. A fourth air jet 66 is mounted to the subframe 20 and directs an air jet inwardly into the fourth nip 64. A fourth sensor group 68 is positioned to detect the presence of folded sheet material entering fifth conveyor 70. Fifth conveyor 70 directs the sheet material in an opposite direction from fourth conveyor 60. A reversible directing conveyor 76 is mounted intermediate the fourth conveyor 60 and the fifth conveyor 70. A plurality of directing arms 74 are pivotably mounted to the subframe 20 to extend between the individual belts of the fifth conveyor as seen in FIG. 3. A fifth air jet 80 is mounted to the subframe 20 and directs air inwardly toward the fifth nip 82. A fifth sensor group 84 is disposed adjacent the end portion of the fifth conveyor 70 to indicate the presence of sheet material which has been folded and is ready for stacking. The fifth sensor group 84 measures the length, i.e. the dimension along the travel direction, of the sheet for a number of reasons. Initially, if the sheets are to be stacked according to size, the microprocessor 25 can choose the proper stacker. Further, the microprocessor uses length information to cause the sheet to stop in the center of a stacker. In addition, as the aforementioned tablecloths of different sizes are equal in width, i.e. the dimension across the travel direction, the microprocessor can use the length dimension to differentiate tablecloths according to size. Finally, the length may be used to cause the microprocessor to deactivate the third cross fold.

It should be noted that the present invention is not limited to any specific number of folds. Other folding machines, offering other fold patterns may benefit from application of the present invention. The number of folds described herein is illustrative of a typical application, but the inclusion of more folds or the omission of folds, both lateral and cross, are possible without departing from the present invention.

First and second stackers 86,99 are disposed in linear alignment at the discharge end of the fifth conveyor 70. The stackers 86,99 are formed basically as trap doors. While two stackers are illustrated and provide a sorting feature, a single stacker may be used within the contemplated scope of the present invention. The first stacker 86 includes two opposed conveyors 88,92 trained around rolls 90,94. The opposed conveyors 88,92 are pivotably mounted to the subframe 20 in an opposed fashion and are driven in the same direction. The first stacker conveyors 88,92 are pivotably mounted at opposite ends so that adjacent ends of each conveyor fall away from each other when the trap door effect is initiated. A similar arrangement is provided for the second stacker 99 including second stacker conveyors 100,104 trained around second stacker rolls 102,104. The stackers may not necessarily be conveyors but may be plates onto which the sheets are driven. A set of removal conveyors are disposed directly beneath the stackers. The overall configuration of the removal conveyors is best seen in FIG. 1. However, their positioning with respect to the stackers is best seen in FIG. 2. As seen in FIG. 1, the removal conveyors comprise a level removal conveyor 114 trained around level removal conveyor rolls 116 and an inclined removal conveyor 118 trained around inclined removal conveyor rolls 120. Both removal conveyors are in communication with one another so that sheet material stacked on the level removal conveyor 114 can be driven out of the apparatus 10 upwardly at an angle for easy hand removal. Turning now to FIG. 2, it can be seen that the first level removal conveyor 110 is trained around first level removal conveyor rolls 112 and is disposed in a side-by-side relationship with the other removal conveyors. FIG. 2 illustrates an inclined removal conveyor and a level removal conveyor.

Figure 4:
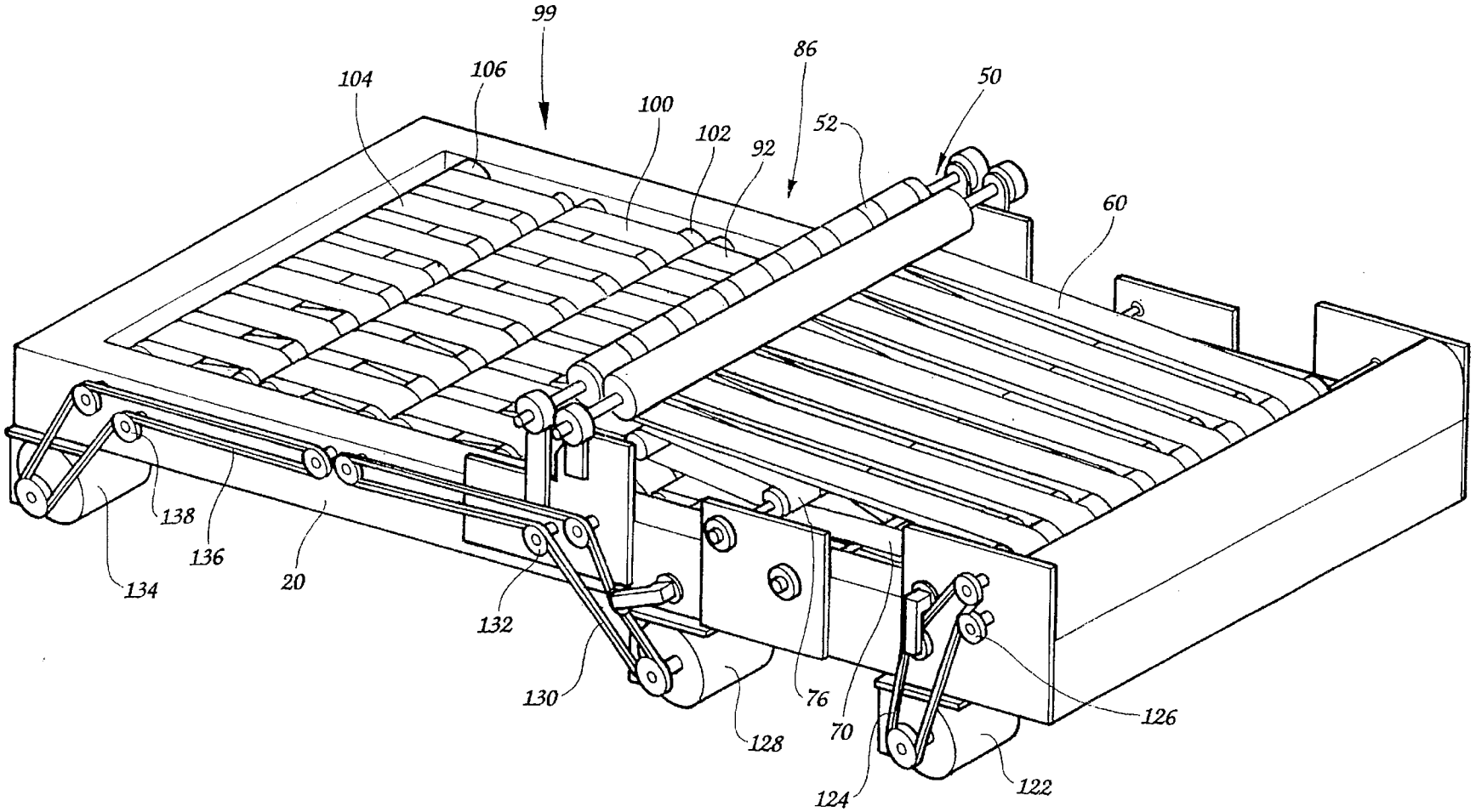
FIG. 4 is a perspective view of the folding and stacking arrangement illustrated in FIG. 3 showing the conveyor drive assembly.

The subframe 20 has been seen to house the lower folding and stacking assembly. The upper folding assembly is substantially conventional with respect to sheet folders and by consolidating the final three folds in one region of the subframe 20 the stackers may be positioned within the frame perimeter thereby saving space. Accordingly, existing machines may be retrofitted with the subframe assembly which is best seen in FIG. 4.

The folding components of the subframe assembly have been previously described with reference to the diagrammatic FIG. 2. FIG. 4 illustrates a self-contained lower folding unit. The subframe 20 has the aforesaid fourth, fifth, and sixth conveyors disposed therewithin. The fourth conveyor 60 and fifth conveyor 70 are driven by a drive motor 122 mounted to one end of the subframe 20. A drive belt 124 is trained around drive pulleys 126 to drive the fourth conveyor 60. Both conveyors 88,92 associated with the first stacker 86 are driven by the first stacker drive motor 128 mounted below the subframe 20 and spaced from the fourth conveyor drive motor 122. A first stacker drive belt 130 is trained around first stacker pulleys to allow the first stacker drive motor 128 to transmit motive power to the first stacker 86. Similarly, at the opposite end of the subframe 20, a second stacker drive motor 134 is mounted. A second stacker drive belt 136 is trained around second stacker pulleys 138 to transmit motive power from the second stacker drive motor 134 to the second stacker 99. While the drive mechanisms are discussed in terms of belts and pulleys, sprockets and chains or other suitable drive mechanism may be used. The self-containment of these drive assemblies results in the lower folding and stacking assembly being adaptable to existing folding apparatus.

Operation of the present invention is generally as follows. While mechanical or electromechanical operation and coordination of the various air jets, sensors and conveyors is contemplated by the present invention, the preferred method is to use a preprogrammed microprocessor to coordinate the folding and stacking functions of the present invention. Initially, a sheet of textile material is fed to the input conveyor 22 from an ironer, some other automatic laundry apparatus, or a textile manufacturing machine. As seen in FIG. 1, the sheet material S is fed into the apparatus within the frame perimeter where its presence is detected by first sensor group 26. The sheets are then fed to the second conveyor 28 and at the end thereof it hangs downwardly. When approximately one-half of the sheet material has passed the first nip 32, or whatever length is specified by the control microprocessor 25, an air blast from air jet 36 directs the center portion of the sheet into the nip 32 where it is folded in half. A similar fold occurs at nip 38 wherein the sheet material is again directed into nip 38 by an air blast from air jet 44. This results in the second lateral fold. The second sensor group 46 measures the length of the sheet along the travel direction and communicates that information to the microprocessor 25 which determines where to stop the sheet above the slot for crossfolding. It should be noted that the sheets are to be folded in a neat fashion and that, while the sensors detect the presence of the sheet, their output can also be used to determine whether folds are crooked or if the sheet is not divided into equal sections.

After going through the second nip 38, the lateral folds are complete and the sheet S is then transported along third conveyor 40 to a position wherein cross-folding can commence. This position has by then been determined by the microprocessor 25. At this position, the sheet is stopped and, with reference to FIG. 2, is directed into the third nip 50 by an air blast from air jet 52. The third nip 50 creates the first cross-fold and from there the sheet is directed along the fourth conveyor 60. The sheet hangs over the end of the fourth conveyor 60 and is directed continually downwardly until the predetermined position previously determined by the microprocessor 25 responsive to information from the third sensor group 48 is attained. Then, the fourth air jet 66 directs an air blast into the sheet material which is thereby directed into the fourth nip 64 and drawn thereinto by tandem movement of the fourth conveyor 60 and the fifth conveyor 70.

The position of the sheet is then detected by the fourth sensor group 68 and, if required, the microprocessor 25 initiates upward movement of the plurality of directing arms 74 which are best seen in FIG. 3. These arms direct the sheet upwardly onto the reversible directing conveyor 76 which is initially moving in a direction to draw the sheet upwardly onto the conveyor 76. When the sheet is a predetermined distance up the directing conveyor 76, the reversible directing conveyor 76 changes direction, the directing arms 74 drop away and an air blast is initiated from the fifth air jet 80 to direct the sheet into the fifth nip 82, causing the third and final cross-fold. The sheet is then directed along the fifth conveyor 70 onto the stackers 86,99. The position, folding accuracy, and size of the sheet is detected by the fifth sensor group 84 in a manner previously described. Once the sheet is out onto the first stacker 86, if chosen by the microprocessor 25, the microprocessor 25 then initiates the opening of the stacker 86 by causing the two stacker conveyors 88,92 to pivot away from one another in the manner of a trap door, allowing the stacked sheet to drop downwardly onto the removal conveyor 110. From there, the sheet is guided upwardly along the inclined removal conveyor, seen in FIG. 1 as 118, where it can be removed from the apparatus 10 by hand. The use of two stackers enhances the versatility of the machine operations by allowing sorting, counting sheets in a stack and adding capacity, but two stackers are not necessary for proper operation.

By the above, the present invention provides a space-efficient folding and stacking machine for flat, sheet-like material, particularly textiles and, more particularly, sheets, both fitted and non-fitted, tablecloths blankets and other flexible sheet like items. The use of the present invention enhances the operation of professional laundries and Textile Mills and may be retrofitted to existing folding machines.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for folding and stacking a multiplicity of individual sheets of material comprising:

an upstanding frame with the outermost extent thereof defining a frame perimeter, said frame including a primary frame defining said frame perimeter and a secondary frame mounted to said primary frame within said frame perimeter;

means mounted to said frame for feeding sheet material through said apparatus in a predetermined travel direction along a predetermined travel path for folding thereof;

folding means disposed along said travel path for folding said sheet material, said folding means including means for performing two lateral folds with the sheet remaining in continuous contact with said feeding means during said lateral folds and means for performing three crossfolds, said folding means being disposed within said frame perimeter with means for performing at least one fold mounted to said primary frame and means for performing at least one fold mounted to said secondary frame; and means for stacking said sheets, said stacking means being disposed within said frame perimeter.

2. An apparatus for folding and stacking a multiplicity of individual sheets of material according to claim 1 and further comprising means for removing said stacked sheet material from within said frame perimeter.

3. An apparatus for folding and stacking a multiplicity of individual sheets of material according to claim 2 wherein said removing means includes a conveyor for moving the sheet material from within said frame perimeter.

4. An apparatus for folding and stacking a multiplicity of individual sheets of material according to claim 2 wherein said stacking means includes at least one trap door positioned above said sheet removing means for dropping folded sheet material thereonto.

5. An apparatus for folding and stacking a multiplicity of individual sheets of material according to claim 1 and further comprising sensing means for sensing the position of said sheet material and said folding means includes means for folding said sheet material into predetermined sections responsive to an input from said sensing means.

6. An apparatus for folding and stacking a multiplicity of individual sheets of material according to claim 5 and further comprising microprocessor means for controlling and coordinating the operation of said feeding means, said folding means and said stacking means.

7. An apparatus for folding and stacking a multiplicity of individual sheets of material according to claim 1 wherein said stacking means is mounted to said secondary frame.

8. An apparatus for folding and stacking a multiplicity of individual sheets of material according to claim 1 wherein said feeding means includes a plurality of conveyors including a plurality of belts trained around rollers, at least one of which is driven.

9. An apparatus for folding and stacking a multiplicity of individual sheets of material according to claim 1 wherein said stacking means includes at least one trap door in communication with said feeding means.

10. An apparatus for folding a multiplicity of individual sheets of material comprising:

an upstanding frame with the outermost extent thereof defining a frame perimeter, including a primary frame defining said frame perimeter and a secondary frame mounted to said primary frame within said frame perimeter;

a plurality of conveyors for feeding sheet material through said apparatus in a predetermined direction along a predetermined travel path for sheet folding at predetermined positions therealong;

folding means disposed along said travel path for folding said sheet material, said folding means including means for performing two lateral folds with the sheet remaining in continuous contact with said feeding means during said lateral folds and means for performing three crossfolds, said folding means being disposed within said frame perimeter and means for performing at least one fold mounted to said primary frame and means for performing at least one fold mounted to said secondary frame; and stacking means including at least one trap door mounted to said frame within said frame perimeter and operatively connected to said conveyors at the end of said travel path for releasing folded sheet material from said conveyors to a support therebelow in a stacked condition.

11. An apparatus for folding and stacking a multiplicity of individual sheets of material according to claim 10 and further comprising means for removing said stacked sheet material from within said frame perimeter.

12. An apparatus for folding and stacking a multiplicity of individual sheets of material according to claim 11 wherein said removing means includes a conveyor for moving the sheet material from within said frame perimeter.

13. An apparatus for folding and stacking a multiplicity of individual sheets of material according to claim 10 and further comprising sensing means for sensing the position of said sheet material and said folding means includes means for folding said sheet material into predetermined sections responsive to an input from said sensing means.

14. An apparatus for folding and stacking a multiplicity of individual sheets of material according to claim 10 and further comprising microprocessor means for controlling and coordinating the operation of said feeding means, said folding means and said stacking means.

15. An apparatus for folding and stacking a multiplicity of individual sheets of material according to claim 10 wherein said stacking means is mounted to said secondary frame.

* * * * *